US009884430B2

(12) United States Patent
Rucker et al.

(10) Patent No.: US 9,884,430 B2
(45) Date of Patent: Feb. 6, 2018

(54) SIDE SHIFT FORCE CONTROL

(71) Applicants: Patrick Steven Rucker, Vancouver, WA (US); Darcy Winter, Moore, OK (US); Md M Haque, Edmond, OK (US); Wolfram Ploetz, Camas, WA (US); Brady Johnson, Kalama, WA (US); Daniel E. Tooke, Boring, OR (US); Michael Jost, Edmond, OK (US)

(72) Inventors: Patrick Steven Rucker, Vancouver, WA (US); Darcy Winter, Moore, OK (US); Md M Haque, Edmond, OK (US); Wolfram Ploetz, Camas, WA (US); Brady Johnson, Kalama, WA (US); Daniel E. Tooke, Boring, OR (US); Michael Jost, Edmond, OK (US)

( * ) Notice: Subject to any disclaimer, the term of this patent is extended or adjusted under 35 U.S.C. 154(b) by 169 days.

(21) Appl. No.: 14/641,370

(22) Filed: Mar. 7, 2015

(65) Prior Publication Data

US 2016/0257016 A1 Sep. 8, 2016

(51) Int. Cl.

| | |
|---|---|
| ***B26D 5/06*** | (2006.01) |
| ***B26D 7/26*** | (2006.01) |
| ***B26D 5/02*** | (2006.01) |
| *B26D 1/20* | (2006.01) |
| *B26D 7/08* | (2006.01) |

(52) U.S. Cl.

CPC ..... *B26D 5/06* (2013.01); *B26D 5/02* (2013.01); *B26D 7/2635* (2013.01); *B26D 1/20* (2013.01); *B26D 7/08* (2013.01); *Y10T 83/7834* (2015.04); *Y10T 83/7838* (2015.04); *Y10T 83/7855* (2015.04)

(58) Field of Classification Search

CPC ..... Y10T 83/7826; Y10T 83/7809; Y10T 83/7822; Y10T 83/783; Y10T 83/7834; Y10T 83/7838; Y10T 83/7843; Y10T 83/7851; Y10T 83/7855; B26D 5/06; B26D 5/02; B26D 5/16; B26D 7/2635; B26D 7/08; B26D 7/2628; B26D 1/20; B26D 1/14; B26D 1/141; B26D 1/143; B26D 1/1435; B26D 1/22

See application file for complete search history.

(56) References Cited

U.S. PATENT DOCUMENTS

| | | | | |
|---|---|---|---|---|
| 4,627,214 | A * | 12/1986 | Anderson | B26D 7/2635 53/71 |
| 5,025,693 | A * | 6/1991 | Tidland | B26D 5/04 83/482 |
| 5,453,867 | A | 9/1995 | Ohya et al. | |
| 6,092,452 | A * | 7/2000 | Adami | B23D 35/008 83/102 |
| 6,732,625 | B1 * | 5/2004 | Boynton | B26D 1/245 83/482 |
| 6,877,412 | B2 | 4/2005 | Dienes | |
| 8,191,451 | B2 | 6/2012 | Stolyar | |
| 8,707,838 | B2 | 4/2014 | Dienes | |

OTHER PUBLICATIONS

U.S. Appl. No. 12/672,561, Chilcott.

* cited by examiner

*Primary Examiner* — Phong Nguyen
(74) *Attorney, Agent, or Firm* — Robert Anton Pasic

(57) ABSTRACT

The device pertains to providing side shift force control using load cell force feedback in the web slitting industry. Further included is a removable means of providing the load cell force feedback without integrating the load cell with the side shift mechanism. This provides for easy maintenance of the blade cartridge and specifically the cutting blade.

6 Claims, 15 Drawing Sheets b a
2006
POSITIVE
NEGATIVE
IS THE FORCE ERROR POSITIVE NEGATIVE OR ZERO?
2008
2007
RETRACT THE SIDE SHIFT ACTUATOR
EXTEND THE SIDE SHIFT ACTUATOR
ZERO OR SMALL
2009
IS THE FORCE CONTROL SCHEME ACTIVE?
YES
C
2010
NO
END

SIDE SHIFT FORCE CONTROL

CROSS-REFERENCE TO RELATED APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND

This invention relates to the web manufacturing industry. Materials like paper, films and various laminates are typically manufactured as a continuous sheet or web of material. During the processing of a continuous web, the web is handled by cylindrical rolls and cut into continuous strips. This cutting is typically required for downstream handling or for producing a final product such as a roll of tape.

The invention is a slitting device. The slitting device includes a circular blade with a sharp cutting edge on the periphery and a blade actuator this slitting device is referred to as a knife holder. The knife holder typically includes a means of extending and translating the circular blade into an anvil which is cylindrical in shape and has a cutting edge located on the periphery of each end. This translation develops a force between the anvil and the blade the invention pertains to this force.

The prior art cited in application Ser. No. 12/672,561 Chilcott teaches a translation mechanism which includes a strain gauge (Page 15 Lines 8-10). This placement of the strain gauge requires that connecting wires extend thru the side shift mechanism. Thus the mechanism cannot be removed without disconnecting these wires. Additionally, this mounting scheme requires flexure of the mechanism in a position that also requires rigid support of the circular slitting blade. This latter requirement causes a tradeoff between rigid support and force sensing accuracy.

Other prior art is cited which includes U.S. Pat. No. 8,707,838 Dienes. This patent teaches driving two circular blades against each other using a motor for each blade. An adaptive control assembly which includes both motors is used to maintain constant pressure against the overlap of the two blades. The specific use of strain gauges is not taught. This means that the force determination could be determined by the amount of current used to move each blade. One of the problems with this type of device is that the cutting edge (regardless of the force determination function) must be moved and in some cases both the top and bottom blade are moved. This will result in a variable width of material being cut. Most slitting applications require exacting control of the slitting location transversely along the width of the web.

An additional prior art example from Deines is U.S. Pat. No. 6,877,412. This patent teaches the use of a pressure sensor in conjunction with a pneumatic cylinder to determine and monitor side force. This patent however does not specifically teach a means of controlling the side force. Again in this example the pressure sensor is an integrated part of the blade support and translation mechanism and so requires removing the wires during blade maintenance.

Lastly, prior art U.S. Pat. No. 5,453,867 Ichikawa is considered. This patent specifically teaches the use of a strain gauge to determine side shift force. However, no method of actively controlling side shift force is provided. Additionally, an integrated translation mechanism is not contemplated.

Some of the embodiments of the invention include a means of determining that the blade and anvil are in contact. As can be imagined as the blade is sharpened it decreases in diameter, since the vertical extension of the blade is fixed relative to the anvil, at some point the blade and anvil will no longer touch. This causes the blade to move over the anvil edge instead of into the side. This condition results in an incorrect side force reading and the controller sets an alarm indicating maintenance is required. This is indicated in FIG. 12 at step 3004.

It is the objective of this invention to address these issues included in the above prior art by providing an improved mechanism and method of slitting materials while being processed in the form of a moving web. Additionally, each and every issue in the prior art is not addressed by each embodiment. In fact some embodiments may not address any of the prior art issues mentioned above.

BRIEF SUMMARY

In view of the previously mentioned prior art, the present invention discloses an improved mechanism and method of slitting a web of material. The present invention removes the force sensor from the side shift mechanism thus making it easy to service by eliminating the need to disconnect the force sensor wiring during maintenance.

In one embodiment of the invention a compliant member in the form of a spring is used to apply the side shift force. This spring is compressed by a linear actuator similar to that used in U.S. Pat. No. 8,191,451 Stolyar. As the spring is compressed the force gradually increases, this allows a load cell and force control scheme to control the side shift force. A combination of the linear actuator in the U.S. Pat. No. 8,191,451 and the instant invention is used to accurately control the amount of force applied.

In another embodiment of the invention the compliant member is replaced with a rigid member. This allows for tighter feedback from a force sensor and when controlled correctly provides a more accurate control of the side shift force. Additionally, this embodiment increases the rigidity of the knife holder and can be useful in some web slitting applications.

In another embodiment of the invention a biasing member is provided that biases the side shift mechanism it's self. In addition to contributing to the force between the blade and the anvil, this biasing member is used to translate the blade away from the anvil.

An embodiment includes a position controlled actuator to compress a compliant member which in turn transfers a force to a removable side shift mechanism 5 which transfers this force sideways, causing the blade to move transversally until it engages a corresponding anvil or lower knife. As the blade contacts the anvil a force between these two objects is created. This force is transferred back to the position controlled actuator thru a mechanism which includes a load cell.

This load cell provides a voltage to a controller. The voltage changes as the force applied by the position controlled actuator changes. The controller is programmed to apply a predetermined amount of force to the blade by positioning the position controlled actuator.

The present embodiment also uses the presence of additional sensing to compensate for temperature of the load cell. This provides a more accurate indication of force as the resistance in a conventional load cell is affected by temperature. Included in the load cell are additionally configuration features which provide this compensation.

BRIEF DESCRIPTION OF THE DRAWINGS

FIG. 10A is a cross sectional view of the dovetail gripping mechanism in the released configuration.

FIG. 10B is a cross sectional view of the dovetail gripping mechanism in the released configuration.

FIG. 13 B is a final page of a force control flow chart

DETAILED DESCRIPTION OF PREFERRED EMBODIMENT

Figure 1:
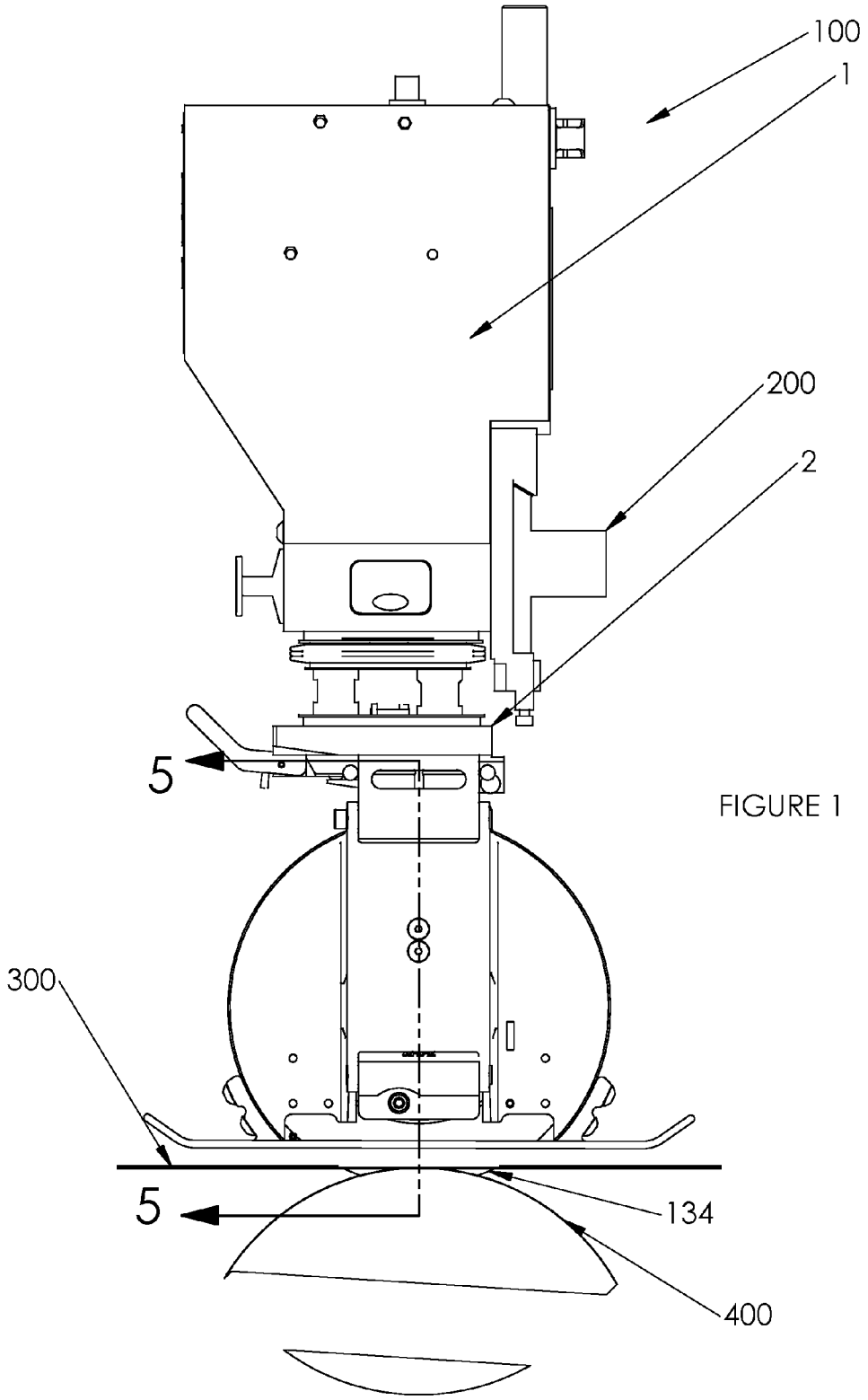
FIG. 1 is a side view of the knife holder and it's typical operation environment.
Figure 4:
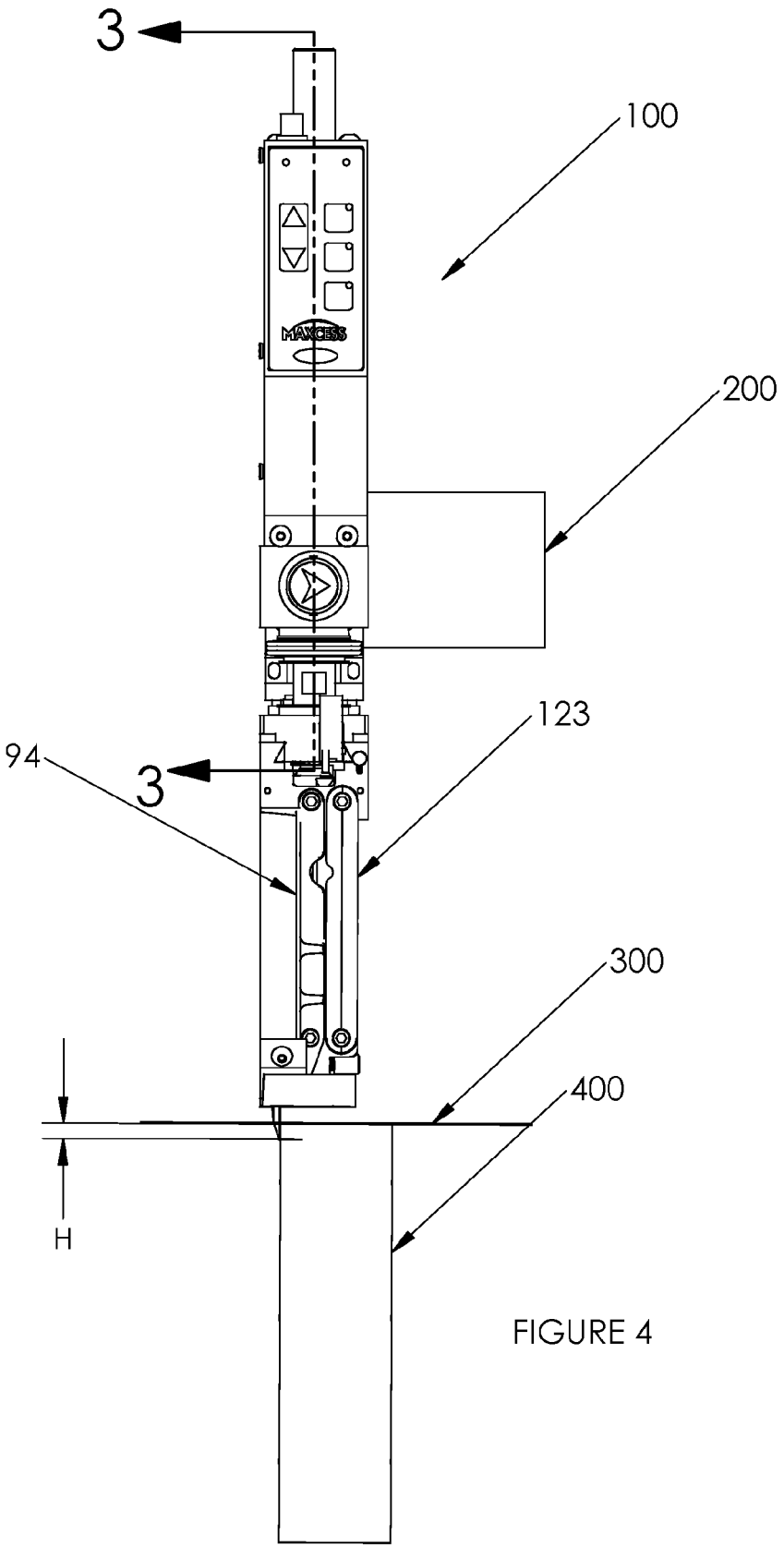
FIG. 4 is a front view of a knife holder illustrating the location of the section of FIG. 3.

In most applications of the invention, the invention is a component of a knife holder 100 shown in FIG. 1. The knife holder 100 is mounted on a transverse beam 200. The knife holder 100 operates to slit a continuous web 300 as it travels under the knife holder 100. An anvil 400 is positioned against the blade 134 of the knife holder 100. The blade 134 and the anvil 400 overlap H, as shown in FIG. 4 such that the web 300 is cut by a scissors action. The force present between the anvil 400 and the blade 134 is applied and controlled.

Figure 2:
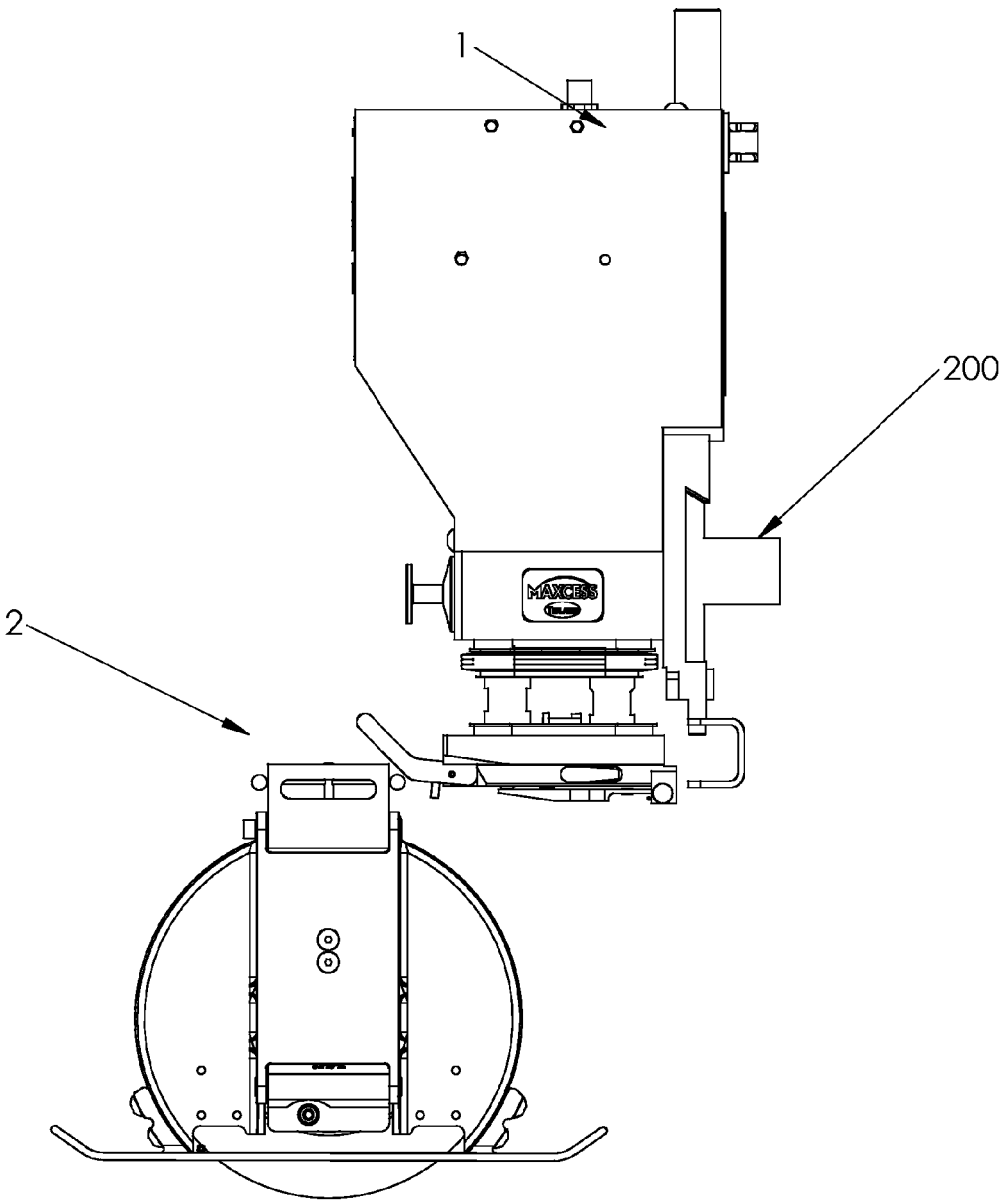
FIG. 2 is a side view of the knife holder with the blade cartridge separated from the blade cartridge actuator.

Also shown in FIG. 1 are the blade cartridge 2 and the blade cartridge actuator 1. This figure establishes two basic components that make up the knife holder 100. In one embodiment of the invention the cartridge actuator 1 can be removed from the blade cartridge 2 this separation is shown in FIG. 2. As will be explained below these are manually separated from the left side of the knife holder 100 as seen in FIG. 2. This separation does not require the disconnection of wires or air lines and is one of the objectives of the invention mentioned in the Summary.

Figure 3:
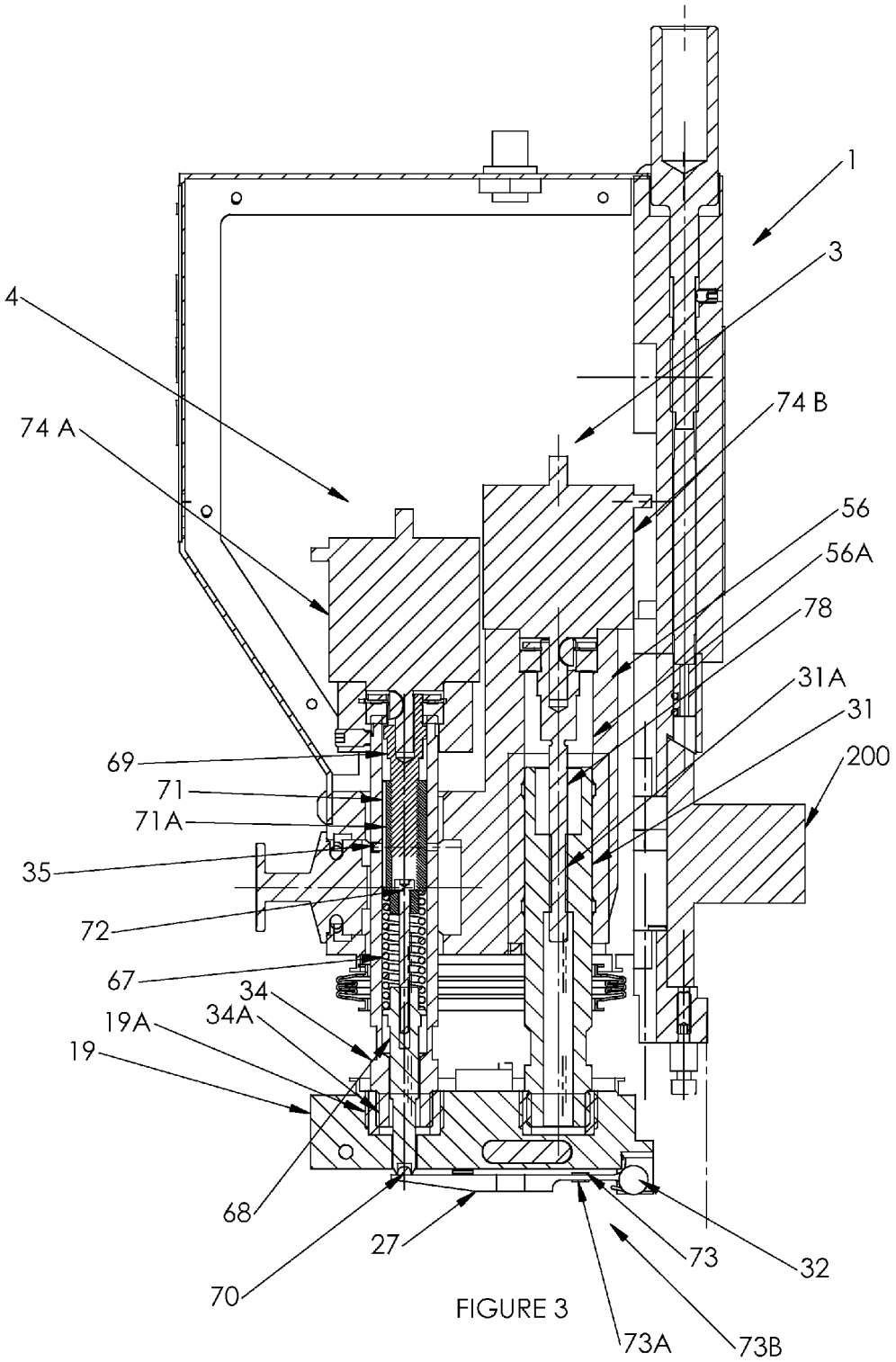
FIG. 3 is a cross sectional view of the blade cartridge actuator.

The cartridge actuator 1 consists of a vertical actuator 3 and a side shift actuator 4. Both of these actuators are driven by motors. FIG. 3 is a cross sectional view of the cartridge actuator 1. The motor 74B on the right in this figure is used to move the blade cartridge 2 vertically. This vertical actuator 3 is similar to the vertical actuator disclosed in the Stoylar patent. The motor 74B is a stepper motor and is controlled to position the vertical actuator 3, of course in other embodiments this motor could be a servo motor with an encoder for controlling position. The motor 74B turns screw 78 which is threaded engaged with a vertical shaft 31. This vertical shaft 31 includes internal threads 31A and is attached to a dovetail member 19. This dovetail member 19 is used to hold the blade cartridge 2. For completeness the motor 74B is attached to a housing 56 which includes a bore 56A for guiding the vertical shaft 31.

A side shift actuator 4 is also attached to the dovetail member 19. The dovetail member 19 provides a threaded hole 19A which receives a threaded shaft 34 using the threaded shaft threads 34A. This combination of dovetail member 19 and threaded shaft 34 is a single embodiment of a body which can be used to provide support for other members of the side shift actuator 4. Unlike the motor 74B of the vertical actuator 3, a side shift motor 74A is attached to the opposite end of the threaded shaft 34. This side shift motor 74A is similar to the motor 74B used in the vertical actuator 3, it is used to control the position and force of the side shift actuator 4. In this embodiment the side shift motor 74A is a stepper motor but could be a servo motor with an encoder. This side shift motor 74A turns a screw 69 which is threaded engaged with a follower 71. This follower 71 includes an axial groove 71A which is engaged by a pin or set screw 35 this prevents the follower 71 from rotating so the follower 71 is driven axially. In one embodiment the follower 71 pushes on spring 67 which in turn pushes on plunger 68. A screw 72 is provided for establishing an initial deflection of the spring 67. This deflection determines how hard the plunger 68 can push prior to deflecting the spring 67 and establishes a preload force between the follower 71 and the plunger 68. In this way the combination of follower 71, spring 67 and plunger 68 acts as a rigid member until sufficient force is applied to deflect the spring 67. In another embodiment, not shown, the follower 71 pushes directly against the plunger 68 this embodiment and spring 67 is eliminated. This allows for more rigid blade support which can be better in some situations.

Also shown, is a hardened ball 70 which is not required but has been found to reduce wear on the plunger 68.

Additionally, a paddle 27 is pivotally attached to the dovetail member 19 by pin 32 as shown in FIG. 3. The plunger 68 pushes the paddle 27 such that it rotates about the pin 32. This paddle 27 is used to transfer force from the plunger 68 to a pusher 128 on the blade cartridge 2 see FIG. 5. As discussed below, this pusher 128 moves a cam 89 which in turn is pivotally mounted to the blade cartridge housing 81 by pin 84 within the blade cartridge 2 causing the blade 134 to land against the anvil 400, of FIG. 5. The mechanism that moves the blade 134 against the anvil 400 is explained next.

Figure 8:
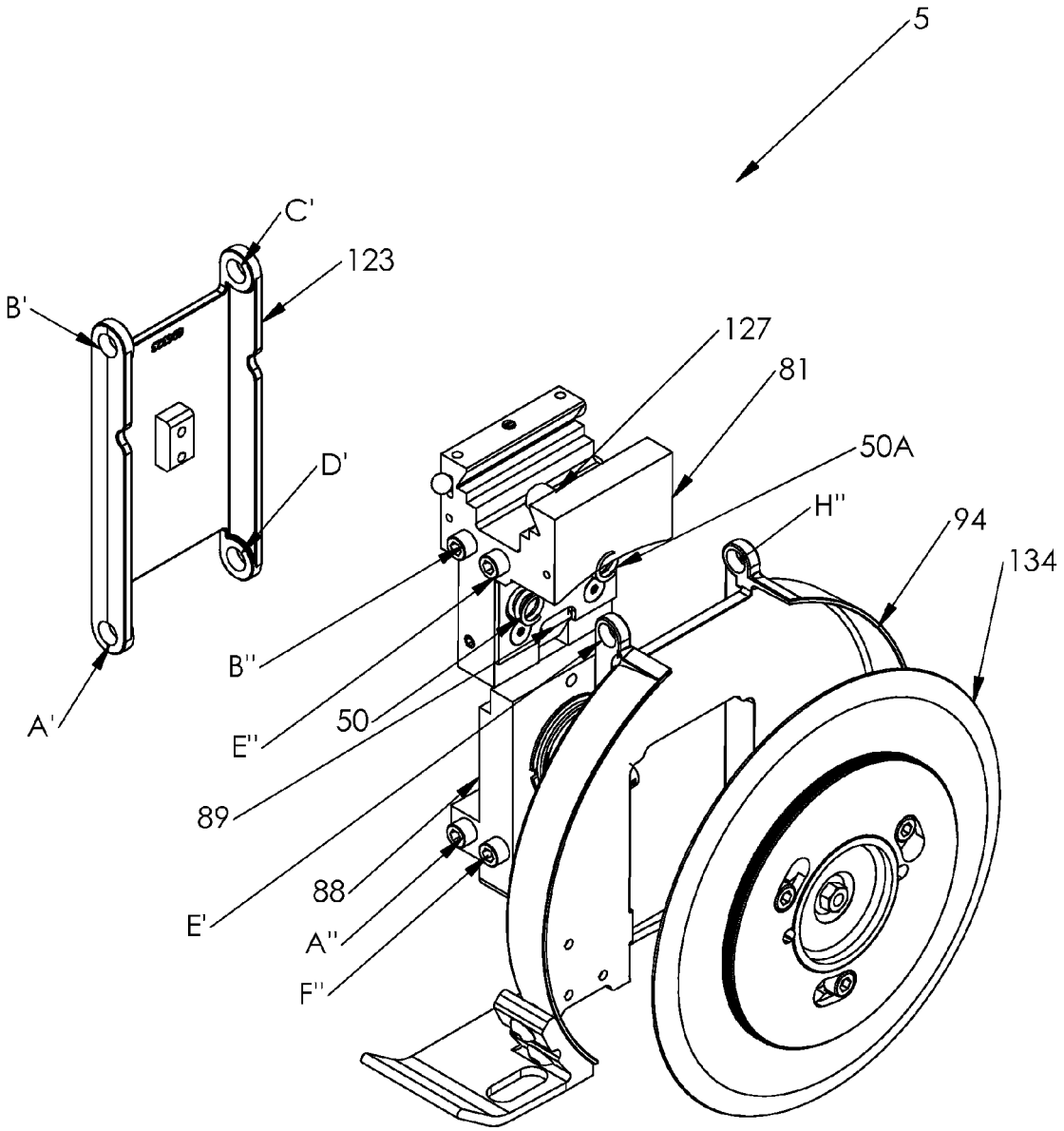
FIG. 8 is an exploded left facing isometric of the blade cartridge actuator.
Figure 9:
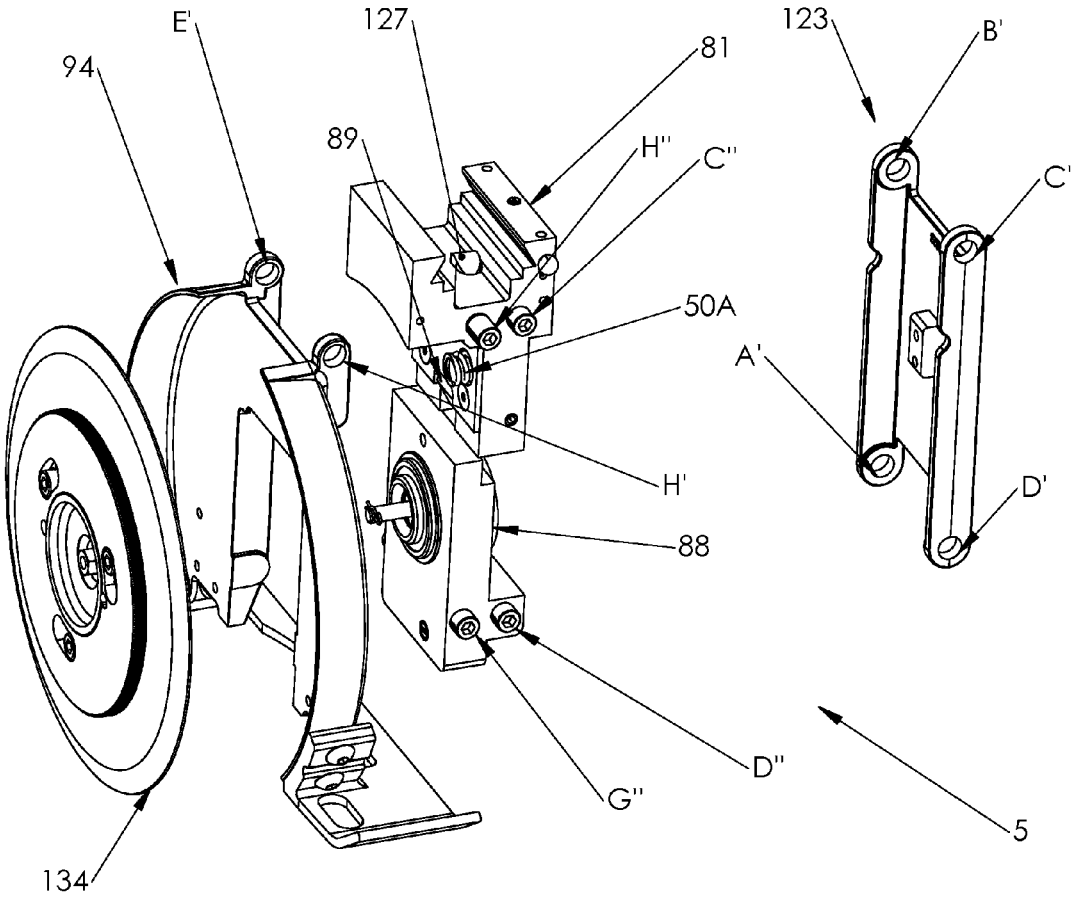
FIG. 9 is an exploded right facing isometric of the blade cartridge actuator.

Referring now, to FIGS. 8 and 9 the side shift mechanism 5 which is a component of the blade cartridge 2 will be explained. This mechanism 5 includes a parallelogram four bar linkage. FIG. 8 shows an exploded isometric of this mechanism 5. The blade cartridge housing 81 acts as a fixed member within this four bar linkage, attached to this blade cartridge housing 81 are two pivot features B" and E" which engage corresponding features B' on arm member 123 and E' on guard member 94. These engagements allow for both the arm member 123 and the guard member 94 to rotate relative to the dovetail member 81.

The blade guide 88 also has two pivot features A" and F", these features engage corresponding features A' on the arm member 123 and a similar feature located on the guard member 94 (this feature is not shown). This causes the blade guide 88 to translate when the arm member 123 and guard member 94 rotate. FIG. 9 is included to illustrate a similar connection scheme on the opposite side of the blade cartridge 2. This figure shows, an arm member 123 with engagement features C' and D', which pivotally engages corresponding features C" on the blade cartridge housing 81 and D" on the blade guide 88.

Figure 5:
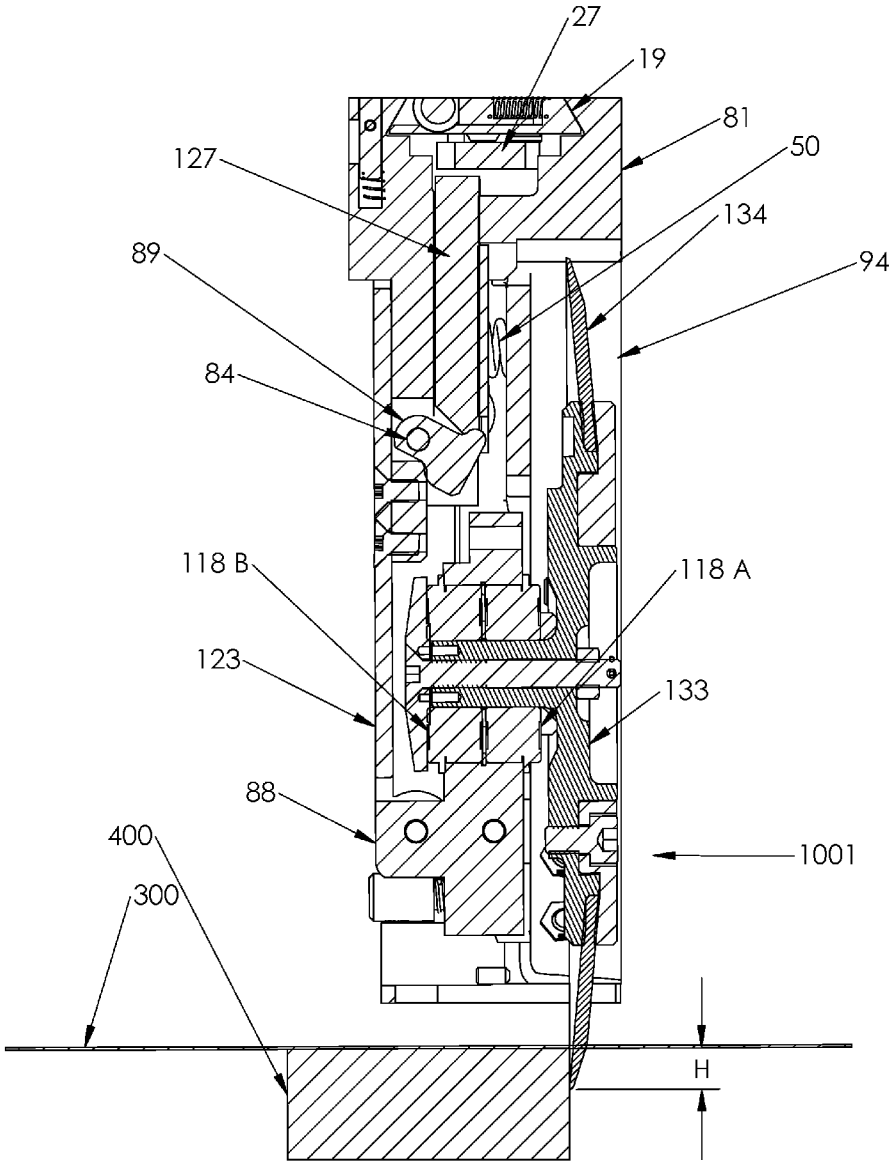
FIG. 5 is a cross sectional view of the blade cartridge the location of this cross section is shown in FIG. 1.
Figure 6:
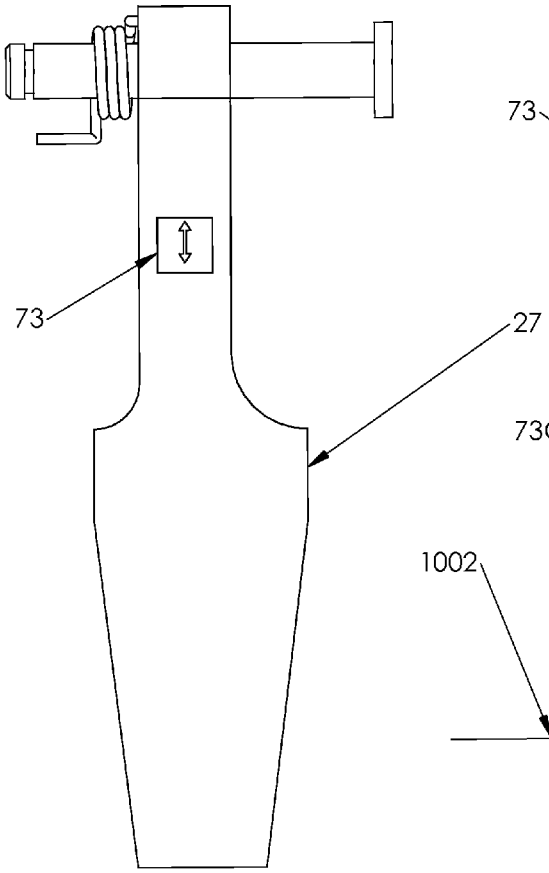
FIG. 6 is a top view of the paddle and load cell.

FIGS. 8 and 9 shows, the pusher 127 which is vertically guided in the blade cartridge housing 81, and cam 89 which is pivotally mounted in the blade cartridge housing 81. The pusher 127 pushes the cam 89 vertically which in turn causes the cam 89 to pivot about pivot 84 (see FIG. 5). The pivoting action of the cam 89 pushes the arm member 123, causing the blade guide 88 to translate in direction 1001 (see FIG. 5) against the anvil 400. Notice also that springs 50 and 50A are compressed as the blade 134 is translated toward the anvil 400. This is best seen in FIG. 5. Spring 50 is shown trapped between guard member 94 and blade cartridge housing 81 as the cam 89 pivot clockwise arm member 123 rotates clockwise causing the blade guide 88 to translate to the left.

To retract the blade 134 from the anvil 400, the motor 74A reverses direction allowing springs 50 and 50A to push the blade guide 88 to the right. This in turn pivots the cam 89 in the counterclockwise direction and pushes the pusher 127 vertically up against the paddle.

The blade 134 is connected to the blade guide 88 by bearings 118 A and 118 B. The bearings allow the blade 134 and supporting shaft 133 to rotate due to pressure from the anvil 400. As the anvil 400 and the blade 134 rotate the web 300 is cut due to the overlap H.

So now that the actuation of the blade 134 against the anvil 400 is understood, an embodiment includes providing a load cell 73B including strain gauges 73 and 73A on the paddle 27, see FIG. 3. Now please see FIG. 5, as the plunger 69 pushes the paddle 27 and pivots it against the pusher 127, the paddle 27 is subjected to a bending stress. This stress causes the strain gauges 73, 73A to provide signals to a controller not shown. This controller determines how much force is being applied to the paddle 27 by the plunger 69 and causes the side shift motor 74A to retract or extend the plunger 69 such that a predetermined force is applied.

As mentioned above the blade cartridge 2 and the blade cartridge actuator 1 can be easily separated as shown in FIG. 2. The gripping mechanism 600 for separating these devices is explained with reference to FIGS. 10A and 10B and FIGS. 11A and 11B. FIGS. 11A and 11B show the mechanism in the attached configuration. The lever 21 is rotated down around pin 50, this allows the spring 603 to drive the wedge 602 to the right. As shown in FIG. 11B the wedge 602 has surface 602A which presses against similar wedge like surfaces onto the dovetail member 19 at surface 19A and gripper 604 at surface 604A. This causes surface 604A to press against a mating surface on the dovetail member 19, in this manner the blade cartridge 2 is attached to the blade cartridge actuator 1.

Figure 10:
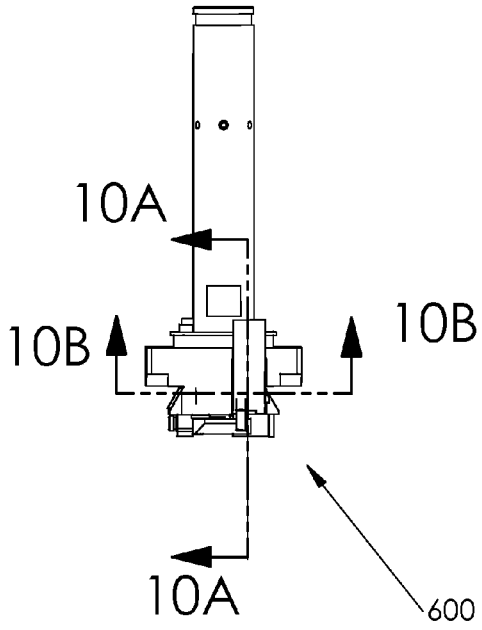
FIG. 10 is a front view of the dovetail gripping mechanism in the released configuration illustrating the location of FIG. 10A and FIG. 10B.
Figure 11:
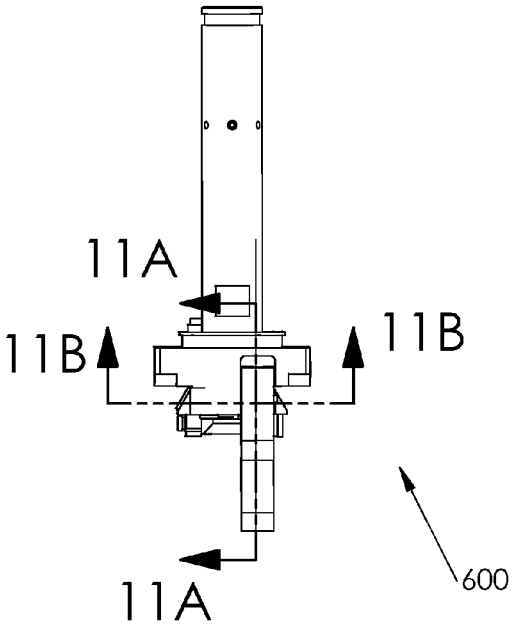
FIG. 11 is a front view of the dovetail gripping mechanism in the gripping configuration illustrating the location of FIG. 11A and FIG. 11B.
Figure 11A:
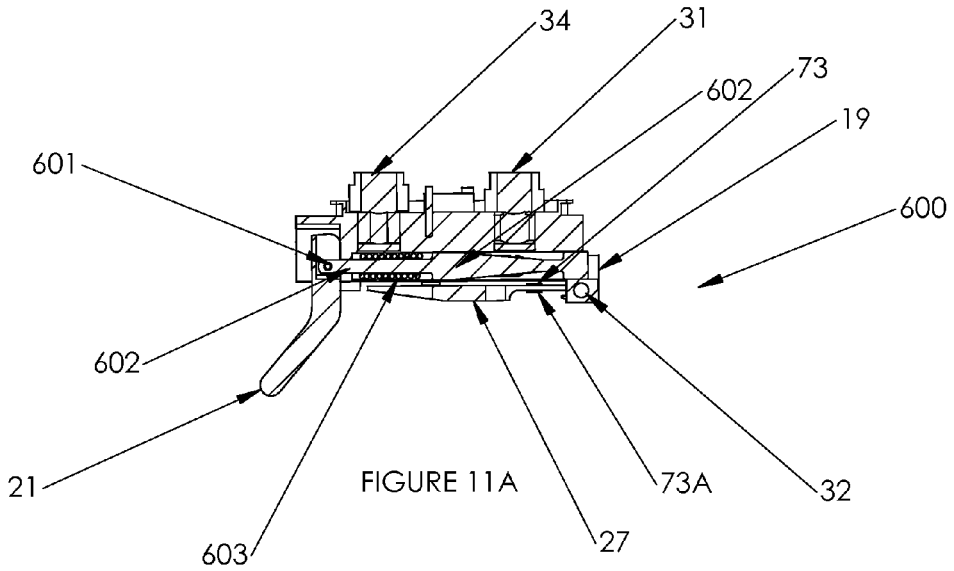
FIG. 11A is a cross sectional view of the dovetail gripping mechanism in the gripping configuration.
Figure 11B:
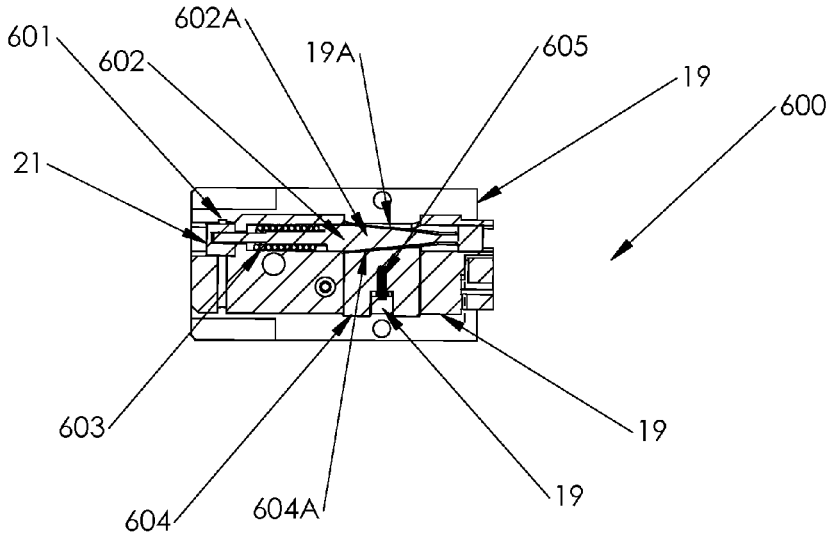
FIG. 11B is a cross sectional view of the dovetail gripping mechanism in the gripping configuration.

By rotating the lever 21 as shown in FIGS. 10A and 10B, the wedge 602 is moved to the left due to the location of the pin 601 on the lever 21. This action over comes the force of the spring 603 on the wedge 602. As the wedge 602 moves to the left, the gripper spring 605 (shown in the loaded state) pushes the gripper 604 upward (as seen in FIG. 11B) and releases the blade cartridge 2.

Figure 14:
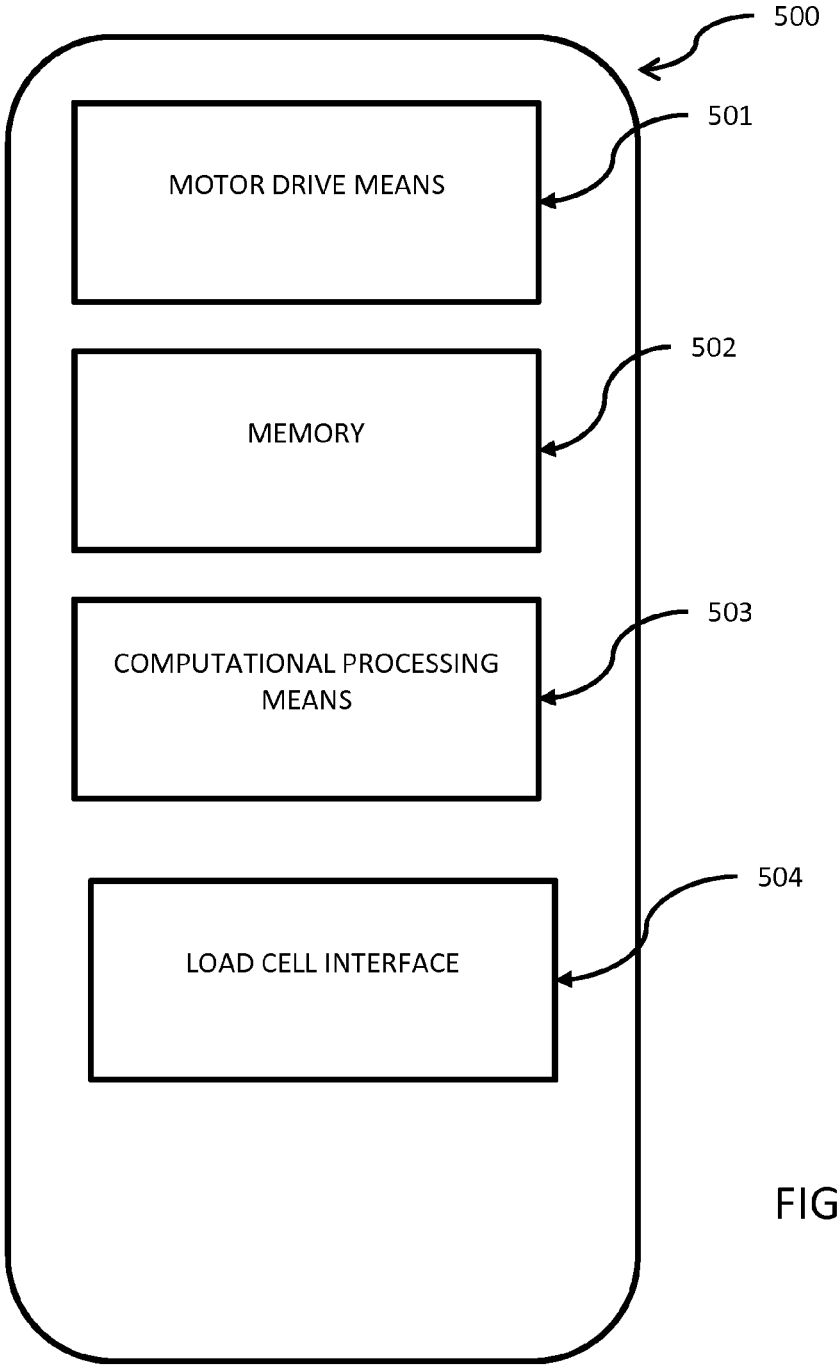
FIG. 14 is a block diagram of the controller components.

To get the maximum benefit of the use the load cell 73B, a controller 500 is included for controlling the amount of side shift force applied to the anvil 400. This controller 500 is shown in FIG. 14 and includes motor driving means 501, memory 502, computational processing means 503 for carrying out the control scheme explained below and load cell interface means 504 for receiving voltage levels from the load cell 73B. In one embodiment this controller 500 includes a microprocessor specifically programmed for carrying out the force control scheme described below.

Figure 15:
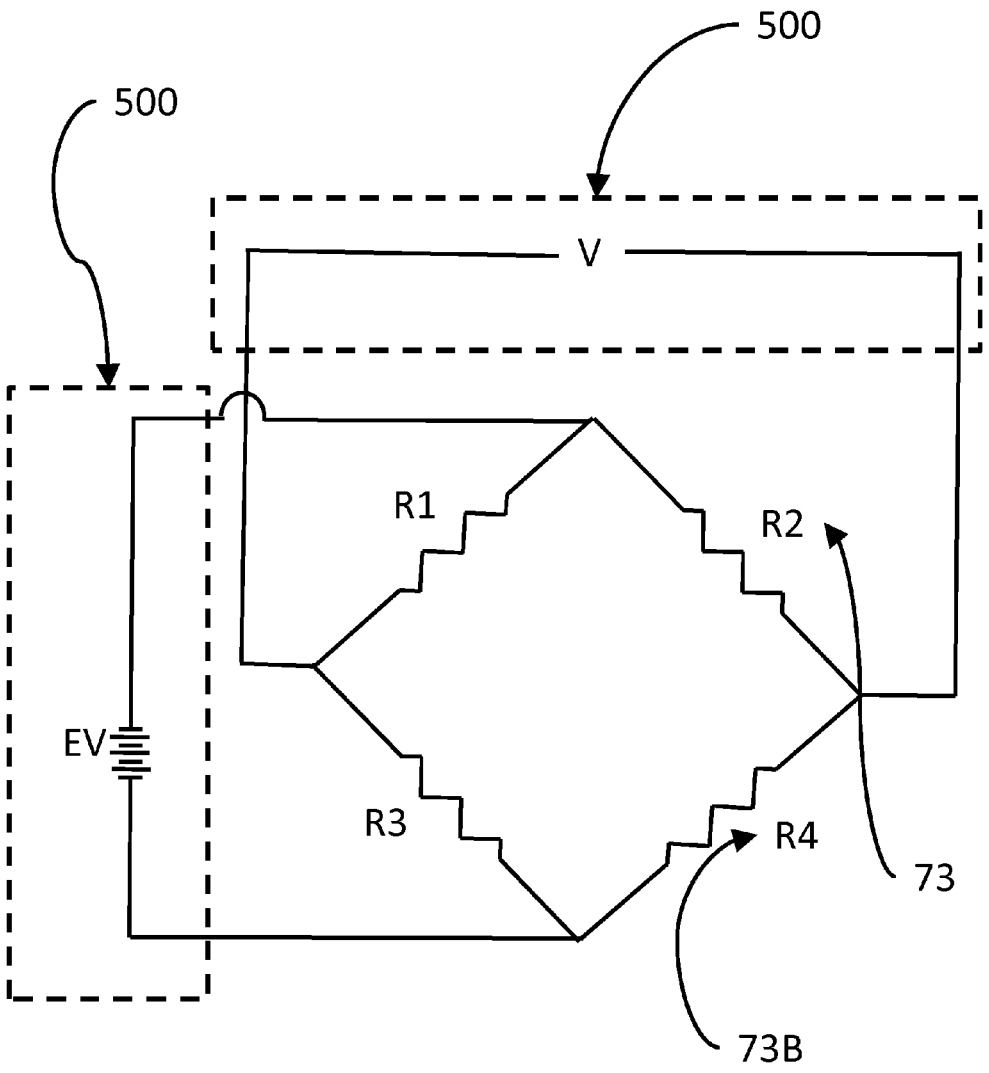
FIG. 15 is an electrical schematic of the load cell circuitry.

The load cell 73B includes the strain gauges 73 and 73A and the separating material 73C which separates the two strain gauges 73 and 73A. A typical load cell interface 504 is shown in FIG. 15. The two load cell strain gauges are also included in this figure. This type of electrical circuit is known in the art as a full bridge device. The controller 500 determines the voltage V as shown in the figure and also provides an excitation voltage EV. Balancing resistors R1 and R3 provide a known resistance and complete the circuit. This particular embodiment provides a simple means of detecting the force 1003 regardless of temperature. As the temperature increases or decreases the material 73C grows, this causes the strain gauges to stretch and increases the voltage signal from each strain gauge. Assuming the separating material 73C has no significant temperature gradient; the difference in these voltage signals remains constant for any temperature.

Another advantage of this particular circuit embodiment is an increase in total signal range due to the geometry. The paddle 27 is loaded such that the strain gauge 73 is in tension while the strain gauge 73B is in compression. This causes strain gauge 73 to increase in resistance as strain gauge 73A decreases in resistance. The net result is a larger voltage signal V present at the controller. The voltage signal V is proportional to the amount of bending on the paddle which is directly proportional to the force 1003 being transmitted to the side shift mechanism 5. Of course, the load cell 73A would work just as well if the strain gauge 73 is loaded in compression and strain gauge 73B is loaded in tension. In other words the strain gauges 73 and 73B are loaded in opposite senses or direction.

Figure 12:
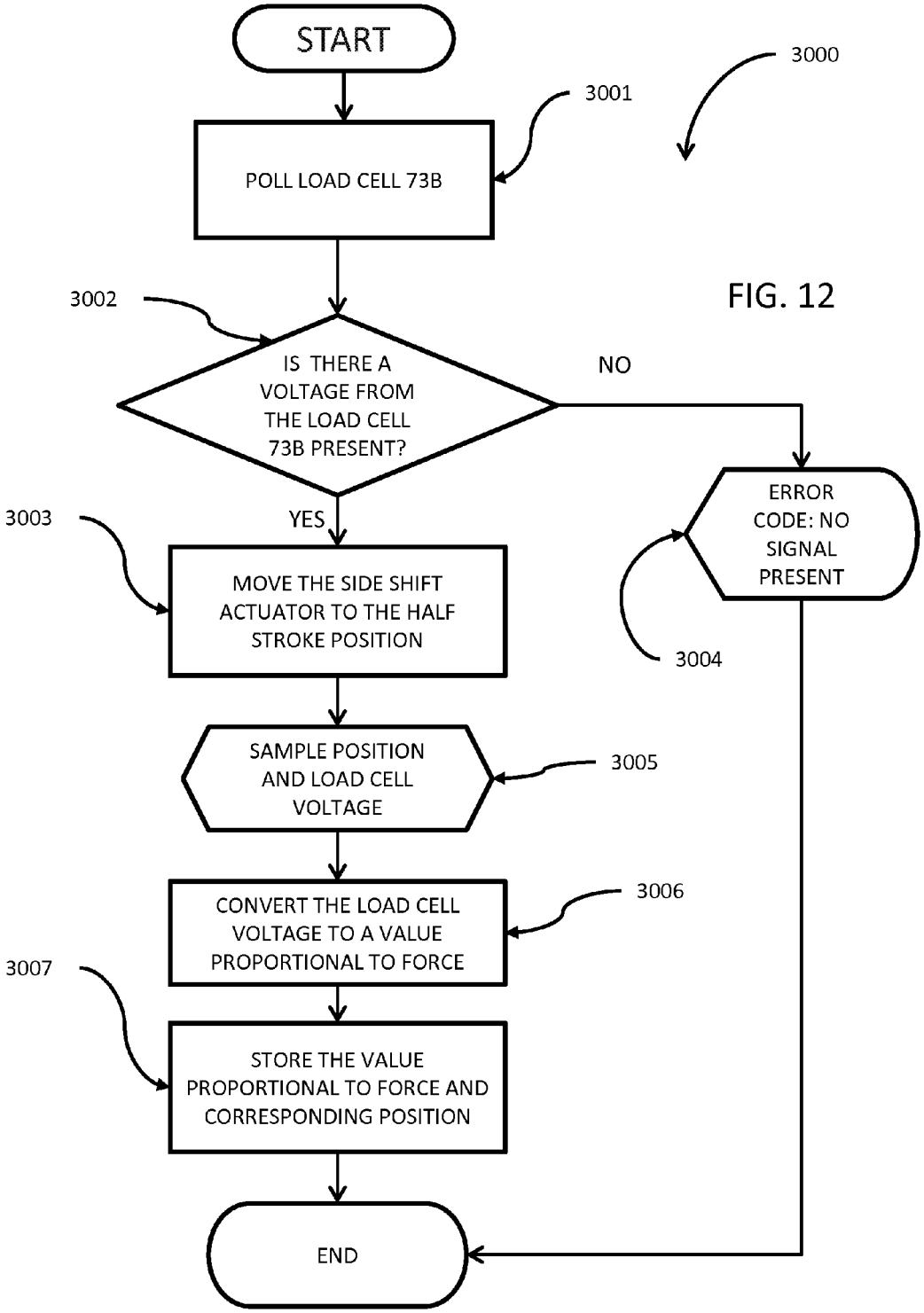
FIG. 12 is a flow diagram of the load cell calibration process.

The controller 500 needs to understand how to determine the side shift force given the voltage signal V. To determine this relationship a calibration scheme 3000 has been provided, refer to calibration flow chart of FIG. 12. The controller 500 polls the load cell 73B, in step 3001. Next, the controller 500, using computational processing means 503 determines if a voltage signal V is received from the load cell 73B as provided in step 3002 of calibration scheme 3000. If one of the load cell voltage signal V is not provided the controller 500 sends an error message at step 3004 and the calibration scheme ends. However, if there is a voltage signal V from the load cell 73B, then the controller 500 moves the side shift motor 74A such that the blade 134 is half way extended.

Figure 7:
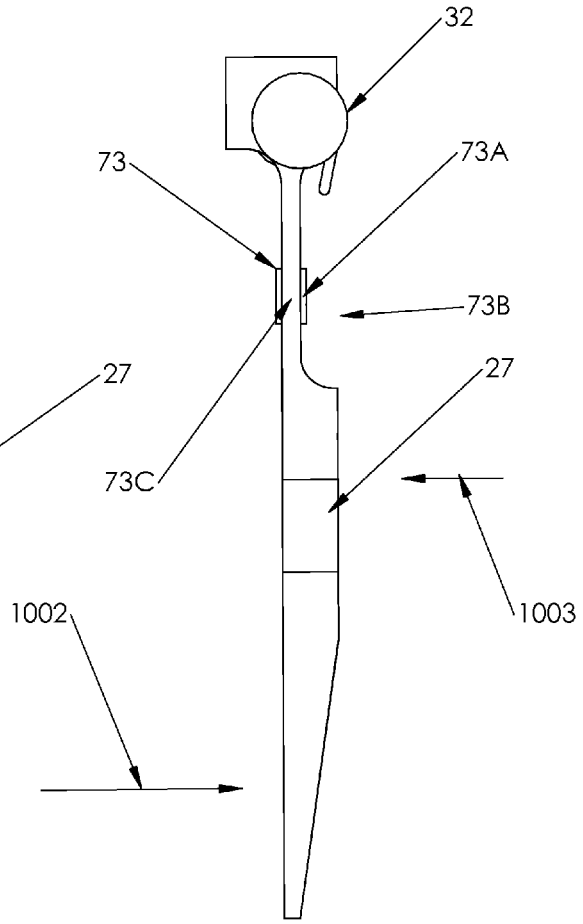
FIG. 7 is a side of the paddle and load cell showing the relative locations of the plunger and pusher forces.

In this position springs 50 and 50A shown in FIG. 8 are pushing against the guard member 94 which, thru the side shift mechanism 5 and applies a force against the cam 89 and the pusher 127. This force is transferred to the paddle 27. This force on the paddle 27 is shown as item 1003 in FIG. 7. As shown in FIG. 7 the plunger 68 (of FIG. 3) applies a force shown as item 1002. These two forces 1003 and 1002 along with a reaction force at pin 32, causes the paddle 27 to develop a bending stress. This bending stress, as understood by elementary mechanics of materials, causes the strain gauge 73 to stretch and strain gauge 73A to compress. This stretch and compress characteristic causes the voltage across each of these strain gauges 73 and 73A to change.

The calibration scheme 3000 now continues to step 3005 where the controller 500 saves the side shift motor 74A position and the load cell 73B signal voltage V to memory 502. Next at step 3006, the controller equates the signal voltage V with a known force 1003. This force is pre-established and saved in the controller memory 502 during manufacturing of the device. At step 3007 the controller 500 stores this signal voltage V (now referred to as calibration value) and the side shift motor 74A position.

During installation the knife holder 100 needs to be positioned relative to the anvil 400 such that with the side shift mechanism 5 in the half stroke extended position, the blade 134 and the anvil 400 are just touching. This allows for better control of the force between the blade 134 and the anvil 400.

First the controller 500 positions the vertical actuator 3 into an extended position using the motor drive means 501 and motor 73B. Then the controller 500 positions the side shift actuator 4 in a half extended position using the motor drive means 501 and motor 73A. The embodiment is now ready to start the slitting force control scheme 2000 shown in FIGS. 13A and 13B.

Figure 13A:
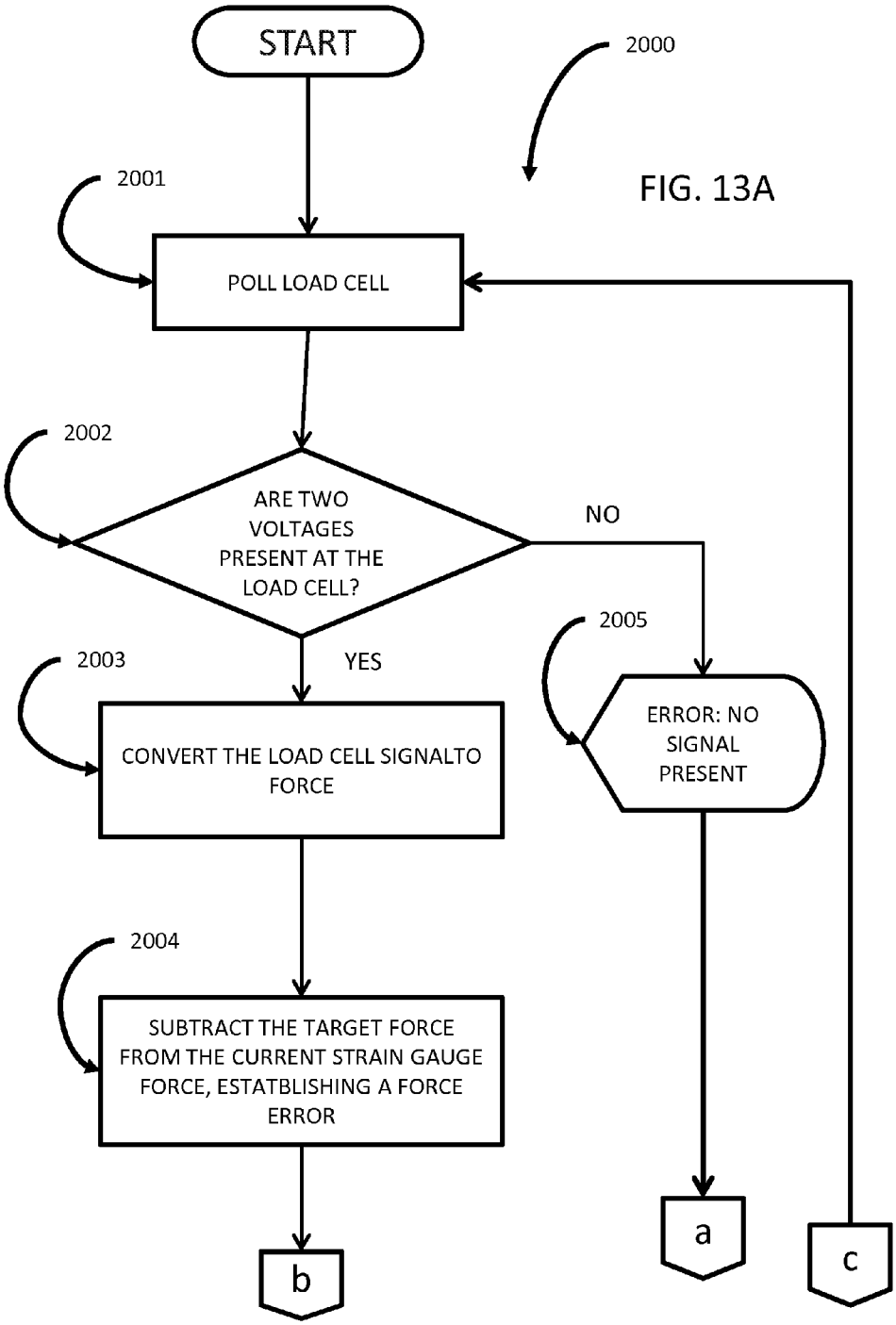
FIG. 13 A is a first page of a force control flow chart.
Figure 13B:
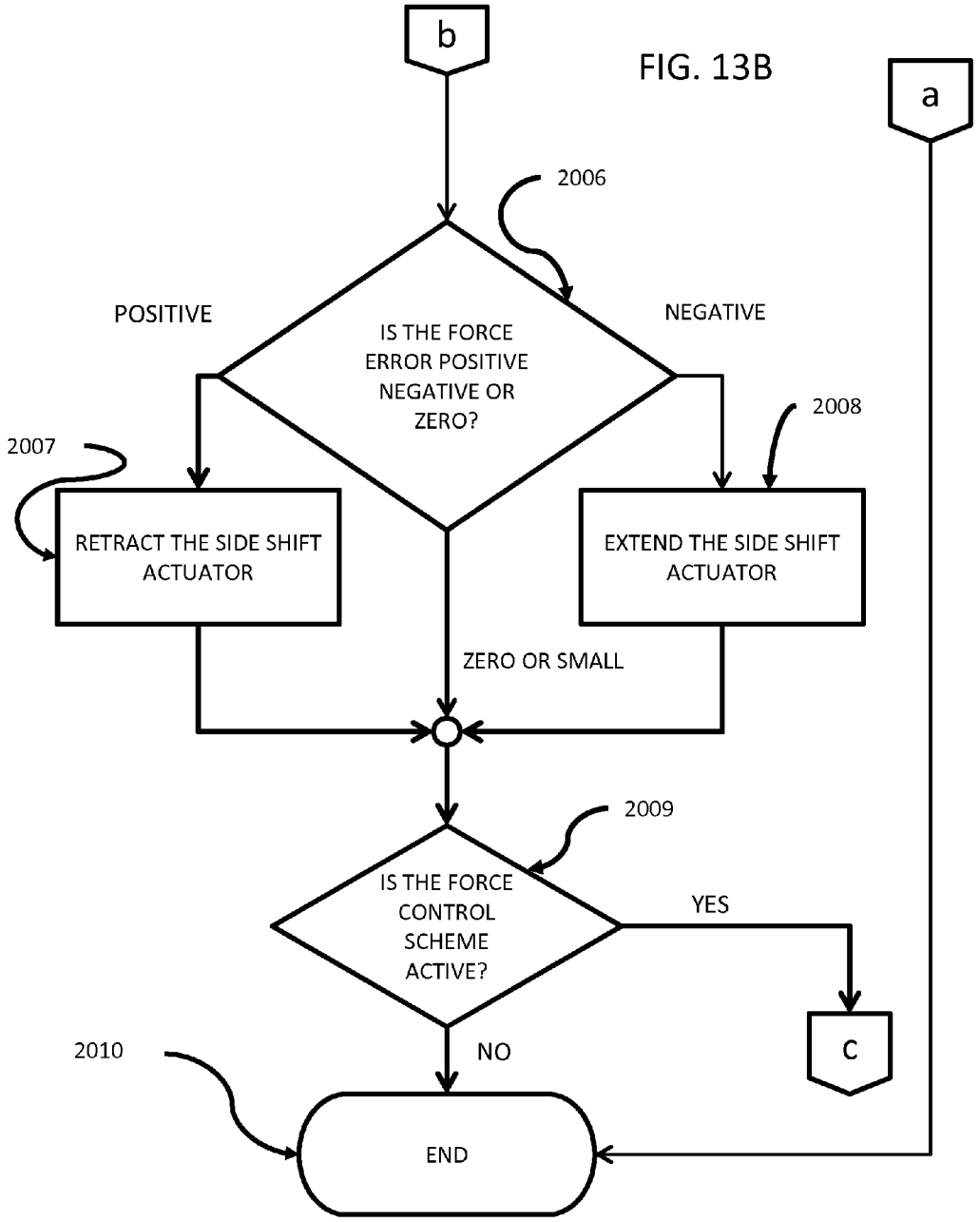

During the slitting operation, the controller uses the voltage signal V from the load cell 73B to determine where the motor 74A should position the paddle 27 using the force control scheme 2000 shown in FIGS. 13A and 13B. As shown in FIG. 13A (step 2001) the controller 500 polls the load cell 73B to determine if a voltage signal V is present at the load cell 73B. If this voltage signal is missing the controller 500 goes to step 2005 and sends an error code and the force control scheme 2000 is terminated. Otherwise, the controller 500 proceeds to step 2003 and converts the load cell 73B voltage signal V to a force value using the computational processing means 503 and the saved calibration value stored in memory 502. Specifically, this is accomplished by multiplying the current voltage signal by the known half stroke force and dividing by the calibration value and obtaining a value representative of said force value. Then the controller 500 continues to step 2004 and subtracts the target force from the force determined in the previous step 2003 as shown in step 2004, this step produces a value referred to as force error. This is done with the use of the computational processing means 503 of the controller 500. Proceeding now to step 2006 shown in FIG. 13B, the controller determines if the force error is positive, negative or within an acceptable absolute value. If this force error is negative the controller 500 goes to step 2008 and extends the side shift actuator 4. If this force error is positive the controller 500 retracts the side shift actuator 4 as indicated in step 2007. Additionally, the controller 500 proceeds to step 2009, if the force error is within an acceptable absolute value. Also the control scheme 2000 shows that after steps 2007 and 2008 the controller 500 proceeds to step 2009. At step 2009 the controller 500 determines if the force control scheme is still active, if not the force control is terminated, if it is the controller 500 proceeds to step 2001.

To determine if the force error is within a reasonable absolute value one needs to consider the update frequency of the force control scheme 2000. It this particular value is to large wide fluctuations in the side shift force will result. On the other hand if this value is to small the control scheme will produce small vibrations and increase power consumption. This can cause some components to overheat and fail prematurely. This absolute value is determined experimentally by simply trying various values until a good compromise has been determined.

The inventor submits the above embodiment of the invention with the expressed understanding that this embodiment is simply one possible way of applying the invention and is not to be used to limit the claims.

We claim:

1. An apparatus comprising:

a body;

a paddle pivotally attached to said body;

a plunger linearly guided by said body for applying a force to said paddle;

a load cell mounted onto said paddle for converting the amount of said force applied to said paddle to an electronic signal;

a side shift mechanism including a blade, attached to said body and in contact with said paddle for converting said force into a side shift force for laterally positioning said blade;

said side shift mechanism additionally includes;

a blade cartridge a pusher, vertically guided in said blade cartridge in contact with said paddle for receiving said force; and a cam pivotally attached to said blade cartridge and in contact with said pusher for laterally translating said blade.

2. The apparatus of claim 1 wherein said side shift mechanism includes:

parallelogram four bar linkage in contact with said cam for translating said blade as said cam pivots; and a spring for biasing said parallelogram four bar linkage against said cam.

3. An apparatus comprising:

a body;

a paddle pivotally attached to said body;

a plunger linearly guided by said body for applying a force to said paddle;

a load cell mounted onto said paddle for converting the amount of said force applied to said paddle to an electronic signal;

a side shift mechanism including a blade, attached to said body and in contact with said paddle for converting said force into a side shift force for positioning said blade;

a gripping mechanism for attaching said side shift mechanism to said body;

wherein said load cell comprises;

a full bridge device including two strain gauges a first strain gauge positioned on the top and a second strain gauge positioned on the bottom of said paddle such that both compression and tension on the paddle is included in a load cell signal.

4. The apparatus of claim 3 wherein said gripping mechanism comprises:

a lever located on said body;

a wedge pivotally attached to said lever and guided linearly by said body;

a spring in communication with said wedge such that said lever is biased against said body;

a gripper in communication with said wedge such that said wedge presses said gripper against said body causing friction to hold a side shift mechanism in position.

5. The apparatus of claim 3 wherein said side shift mechanism includes:

blade cartridge housing;

a pusher, vertically guided in said blade cartridge housing in contact with said paddle for receiving said force; and a cam pivotally attached to said blade cartridge housing and in contact with said pusher for laterally translating said blade.

6. The apparatus of claim 5 wherein said side shift mechanism includes:

parallelogram four bar linkage in contact with said cam for translating said blade as said cam pivots; and a spring for biasing said parallelogram four bar linkage against said cam.

* * * * *